US010233820B2

(12) United States Patent
Doveri

(10) Patent No.: US 10,233,820 B2
(45) Date of Patent: Mar. 19, 2019

(54) WATER-COOLED INTERNAL COMBUSTION ENGINE

(71) Applicant: PIAGGIO & C. S.P.A., Pontedera (PI) (IT)

(72) Inventor: Stefano Doveri, Pontedera (IT)

(73) Assignee: PIAGGIO & C. S.P.A., Pontedera (PI) (IT)

( * ) Notice: Subject to any disclaimer, the term of this patent is extended or adjusted under 35 U.S.C. 154(b) by 0 days.

(21) Appl. No.: 15/320,883

(22) PCT Filed: Jul. 29, 2015

(86) PCT No.: PCT/IB2015/055715
§ 371 (c)(1),
(2) Date: Dec. 21, 2016

(87) PCT Pub. No.: WO2016/016813
PCT Pub. Date: Feb. 4, 2016

(65) Prior Publication Data

US 2017/0198627 A1 Jul. 13, 2017

(30) Foreign Application Priority Data

Aug. 1, 2014 (IT) ..... RM2014A0449

(51) Int. Cl.
*F01P 7/16* (2006.01)
*F01P 5/04* (2006.01)
(Continued)

(52) U.S. Cl.
CPC ..... *F01P 7/165* (2013.01); *F01P 5/04* (2013.01); *F01P 5/10* (2013.01); *F01P 5/12* (2013.01);
(Continued)

(58) Field of Classification Search
CPC .... F01P 7/165; F01P 5/12; F01P 11/04; F01P 9/04; F01P 5/04; F01P 5/10;
(Continued)

(56) References Cited

U.S. PATENT DOCUMENTS 1,791,572 A 2/1931 Ornberg
4,212,270 A * 7/1980 Nakanishi ..... F01P 7/165 123/41.09
(Continued)

FOREIGN PATENT DOCUMENTS

EP 1020351 A 7/2000
EP 1905975 B 5/2009
(Continued)

*Primary Examiner* — Jacob Amick
*Assistant Examiner* — Charles Brauch
(74) *Attorney, Agent, or Firm* — Volpe and Koenig, P.C.

(57) ABSTRACT

In a water-cooled inner combustion engine (1), in particular for equipping scooters and motorcycles, the arrangement of the outer cooling tubes connected to a radiator is simplified by arranging a by-pass valve (27), arranged directly on the engine block (2) at a discharge opening (18) obtained therein, which, when the cooling water is lower than a reference temperature, prevents the water circulation in the radiator (18) and it addresses it through a by-pass line (26) by implementing a cooling circuit wholly included in the engine block (2).

6 Claims, 8 Drawing Sheets

(51) Int. Cl.

| | |
|---|---|
| ***F01P 5/10*** | (2006.01) |
| ***F01P 5/12*** | (2006.01) |
| ***F01P 9/04*** | (2006.01) |
| ***F01P 11/04*** | (2006.01) |
| ***F02B 61/02*** | (2006.01) |
| ***F02B 75/16*** | (2006.01) |
| ***F02N 11/04*** | (2006.01) |

(52) U.S. Cl.
CPC ..... *F01P 9/04* (2013.01); *F01P 11/04* (2013.01); *F02B 61/02* (2013.01); *F02B 75/16* (2013.01); *F02N 11/04* (2013.01); *F01P 2050/16* (2013.01); *F01P 2070/52* (2013.01)

(58) Field of Classification Search
CPC ... F01P 2050/16; F01P 2070/52; F02N 11/04; F02B 75/16; F02B 61/02
See application file for complete search history.

(56) References Cited

U.S. PATENT DOCUMENTS

| | | | | |
|---|---|---|---|---|
| 4,741,293 | A | 5/1988 | Itoh et al. | |
| 5,992,554 | A | 11/1999 | Hasumi et al. | |
| 2002/0170506 | A1* | 11/2002 | IIzuka ..... | F01P 7/16 123/41.1 |
| 2006/0011151 | A1* | 1/2006 | Huter ..... | F01P 3/02 123/41.29 |

FOREIGN PATENT DOCUMENTS

| | | | | |
|---|---|---|---|---|
| EP | 2573353 | A1 * | 3/2013 | ..... F01P 7/16 |
| JP | S62118023 | A | 5/1987 | |
| JP | 2005240753 | A * | 9/2005 | |
| WO | 2013049919 | A1 | 4/2013 | |

* cited by examiner

WATER-COOLED INTERNAL COMBUSTION ENGINE

The present invention relates to a water-cooled internal combustion engine, in particular for equipping scooters and motorcycles, wherein the radiator fan is fitted directly onto the crankshaft therefrom even the driving force for the cooling water circulation pump is derived.

Herein and hereinafter, the "water-cooled" expression could be referred indifferently to any combustion engine cooled even with a liquid equivalent to water or with water added with cleaning or antifreeze additives. Such water-based, or not, liquids are to be considered obvious equivalent to water; the water-cooled word will be adopted hereinafter only by sake of exposition clarity.

This constructive scheme involves the adoption of a radiator arranged laterally to an engine block; the engine, by way of example, could be a single-cylinder four stroke engine.

In this configuration, apart from the fan of the cooling system, even the electric motor can be fitted directly onto the same shaft.

This configuration requires a careful positioning of the water-circulating lines outside the engine block which, generally, is obtained from only one single-piece melting.

The crankshaft results to be positioned transversally to the longitudinal development of the engine itself, and to the respective transmission organs. Therefore, the radiator will be in a side position with respect to the engine, with the fan lying on a plane substantially parallel to said longitudinal development.

The Japanese patent Nr. JP S 62 118023 relates to a motorcycle engine wherein the radiator and the service electric motor are placed in a side position with respect to the engine, with the fan fitted onto the crankshaft. The described cooling system is applied to a two stroke engine.

The U.S. Pat. No. 5,992,554 describes a side assembly of a radiator, or of radiators on both sides of the engine, wherein a fan is positioned between radiator and engine block.

The European patent EP 1,020,351 A relates to the arrangement of the cooling organs in an engine suitable to a scooter, wherein the radiator is mounted laterally to the engine and wherein the fan is fitted onto the crankshaft.

The European patent Nr. EP 1,905,975 B relates to a system for assembling the radiator laterally to an engine block in a motorcycle engine; it provides a particular position relation between the inlet manifolds of the radiator and the valvetrain box housing the mechanisms for actuating the overhead valves.

The Japanese patent Nr. JP S62 118,023 A relates to a water-cooled engine with a fan mounted on the crankshaft, wherein the opening for outletting the water is arranged on the engine side corresponding to the radiator position, in order to shorten the water discharge line as much as possible.

In the above-described documents, double lines for the discharge and the extraction of the cooling water are provided, as when the engine is cold the water is not sent to the radiator, but on the contrary it is made to recirculate in the engine block, so that the temperature thereof equalizes with that of the engine. Regardless of the different positions of the pump, this involves several lines the positioning thereof is problematic and tends to form a kind of tangle outside the engine, not appreciated even from an aesthetic point of view.

The European patent application Nr. 2,573,353 A1 describes a water-cooled system for scooters wherein a portion of the water lines are outside the engine block.

On the contrary, the U.S. Pat. No. 1,791,572 describes a water-cooled system providing the use of a by-pass valve outside the engine block, thus used to extract the water from the engine block.

The technical problem underlying the present invention consists in overcoming the drawbacks mentioned with reference to the state of art.

Such problem is solved by a water-cooled internal combustion engine as specified above, wherein said circulating pump, comprising a intake nozzle and a discharge nozzle, is arranged on the opposite side of the engine block with respect to the radiator, wherein the cooling system comprises:

- a first cooling circuit having:
  - a discharge line and an extraction line connecting the radiator to said engine block, said lines being constituted by tubes outside the engine block with respective discharge openings, formed in said engine block, and intake opening connected to said intake nozzle of the pump;
  - an inner circuit portion for extracting heat from the engine;
- a second cooling circuit wholly included in said engine block for the cooling water recirculation, comprising a by-pass line, connecting said discharge opening to the intake nozzle of the pump, and said inner circuit portion for extracting heat from the engine; and
- a by-pass valve, arranged on the engine block at said discharge opening, actuated by a thermostat sensible to the water temperature, allowing the water circulation in the first cooling circuit above a reference temperature.

The main advantage of the engine according to the present invention lies in overcoming the tangle of outer cooling tubes and in a rationalization thereof.

The present invention will be described hereinafter according to a preferred embodiment example, provided by way of example and not for limitative purposes by referring to the enclosed drawings, wherein.

By referring to the figures, an internal combustion engine is designated as a whole with 1. It is of the water-cooled type and, in the present example, it is a single-cylinder engine, in particular for equipping scooters and motorcycles.

Such engine 1 is arranged so that the longitudinal development thereof is arranged in the direction of the length of the vehicle receiving it, with a housing which will result to be approximately below the scooter saddle (not visible in figures).

The cylinder received in the engine block is arranged according to the same scheme, tilted ahead so that the cylinder head is oriented to the front side.

Figure 1:
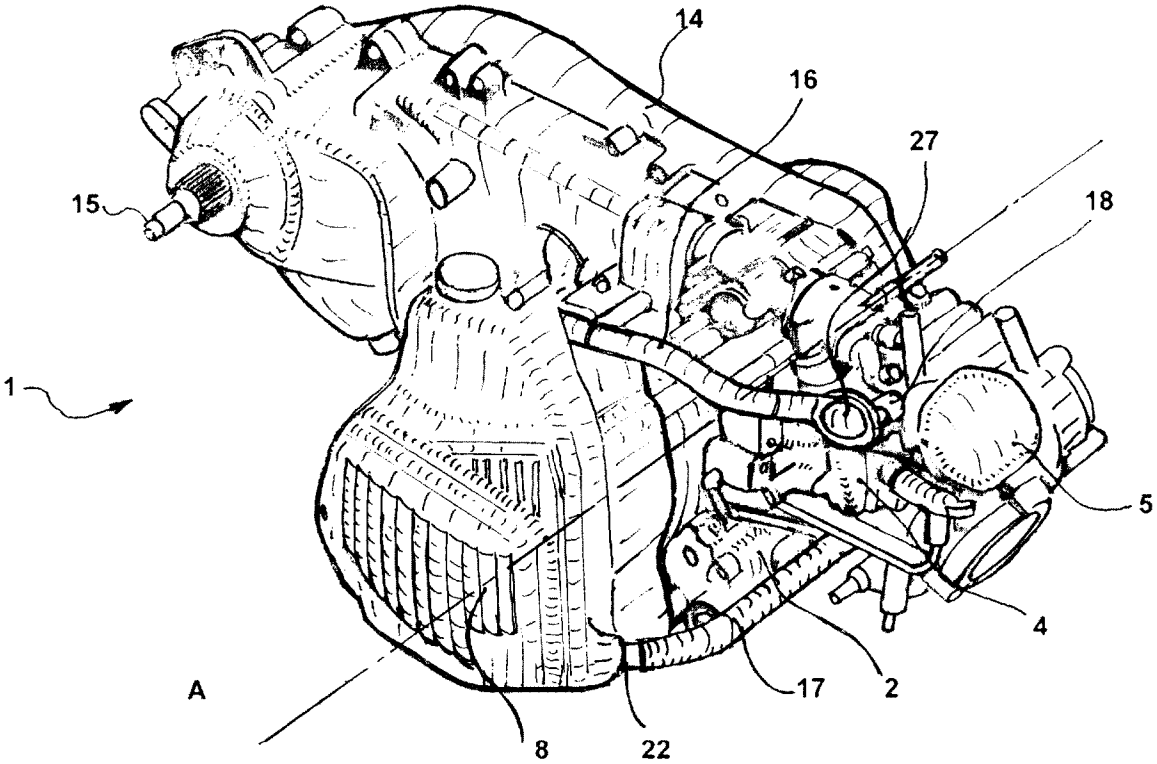
FIG. 1 shows a side axonometric view of the engine according to the present invention.
Figure 2:
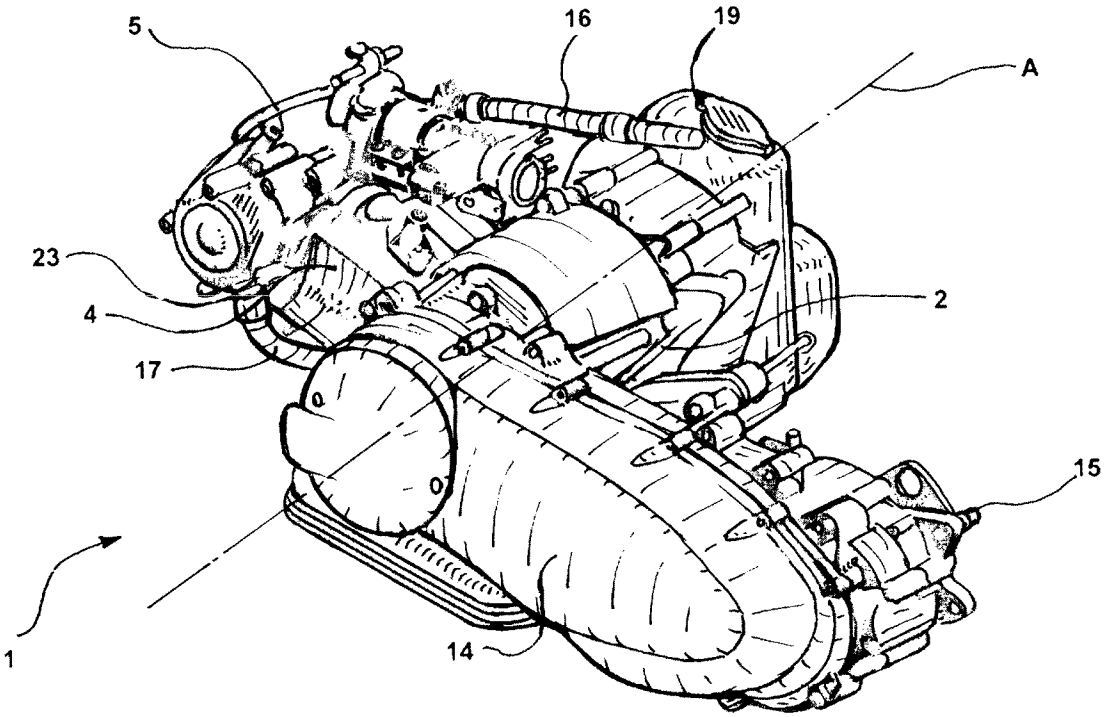
FIG. 2 show an axonometric view of the engine of FIG. 1, on the opposite side with respect to the previous one.
Figure 3:
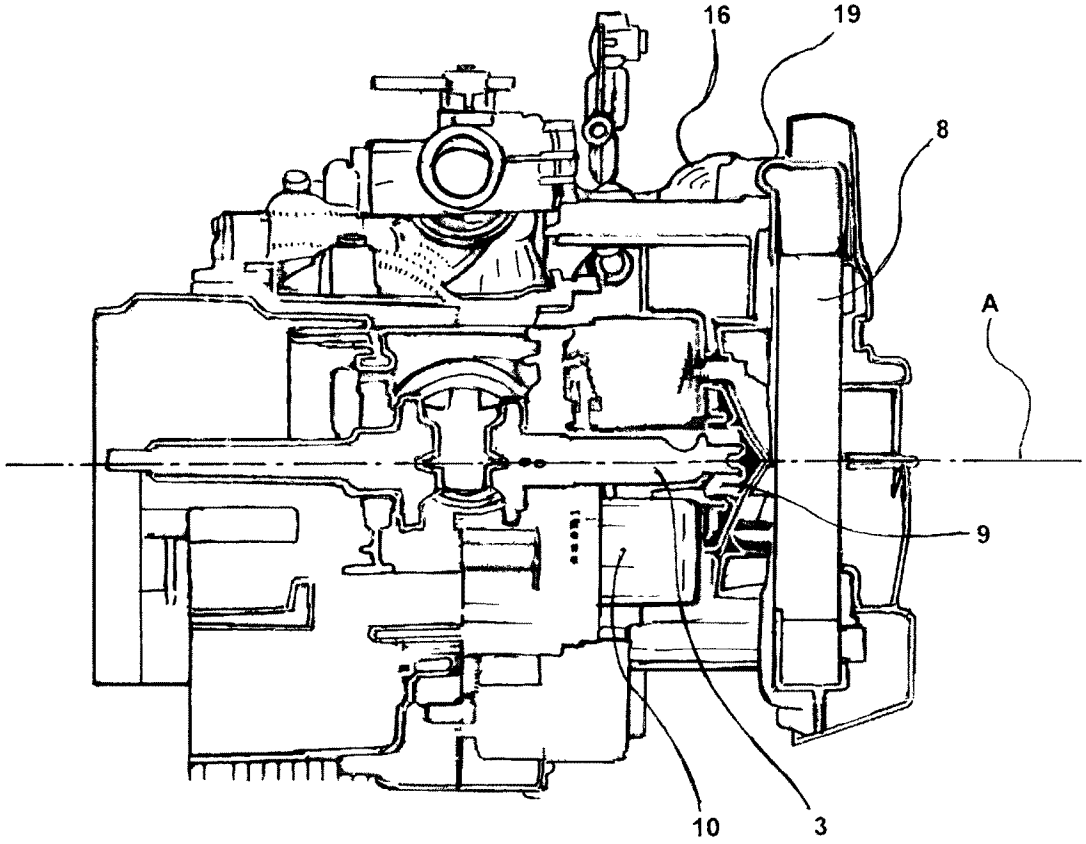
FIG. 3 shows a cross-section view of the engine 1, taken at the driving axle.
Figure 4:
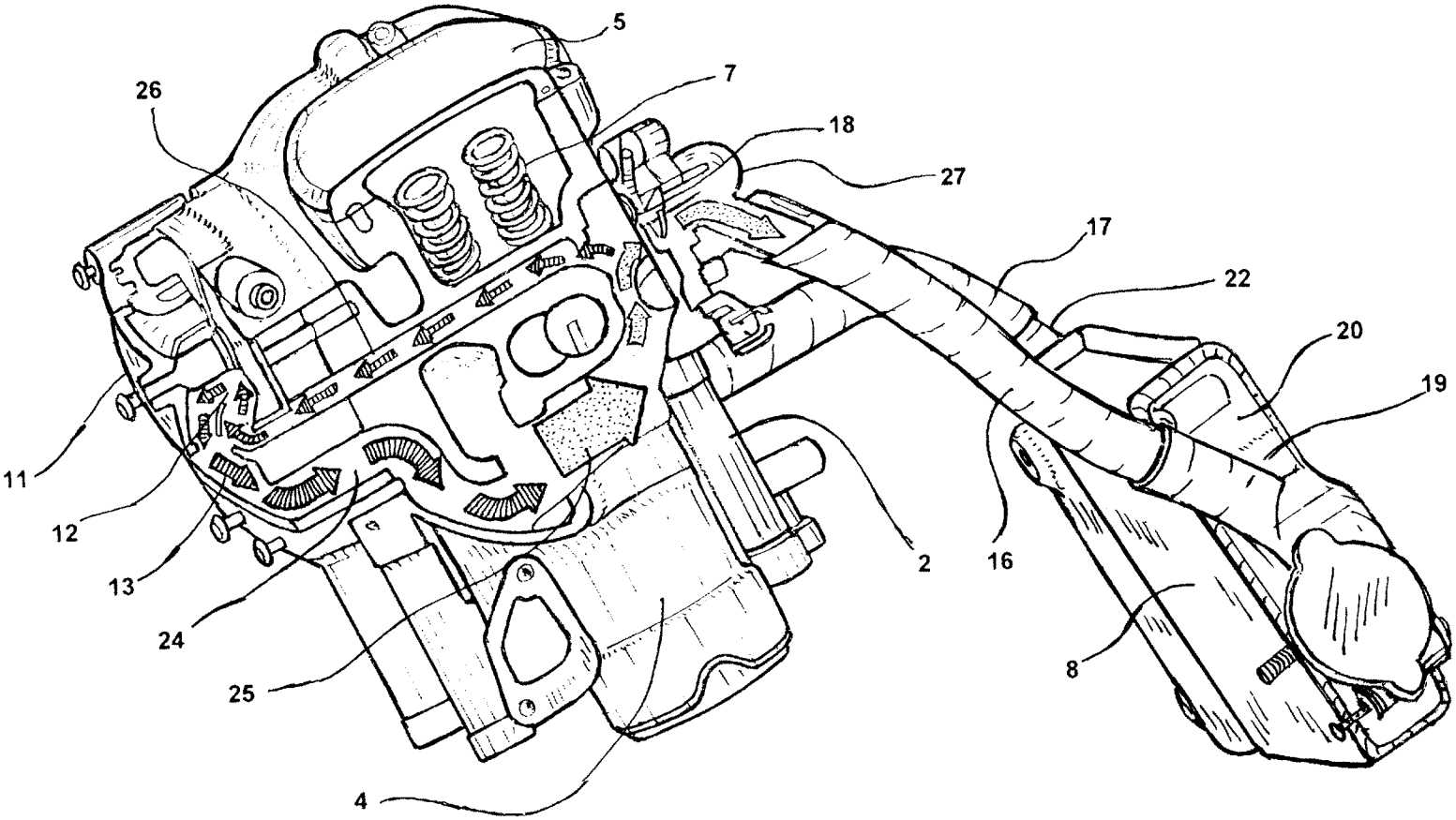
FIG. 4 shows an axonometric view in partial section of the engine of FIG. 1, illustrating the first cooling circuit and the second cooling circuit thereof and the relative circulation.
Figure 5:
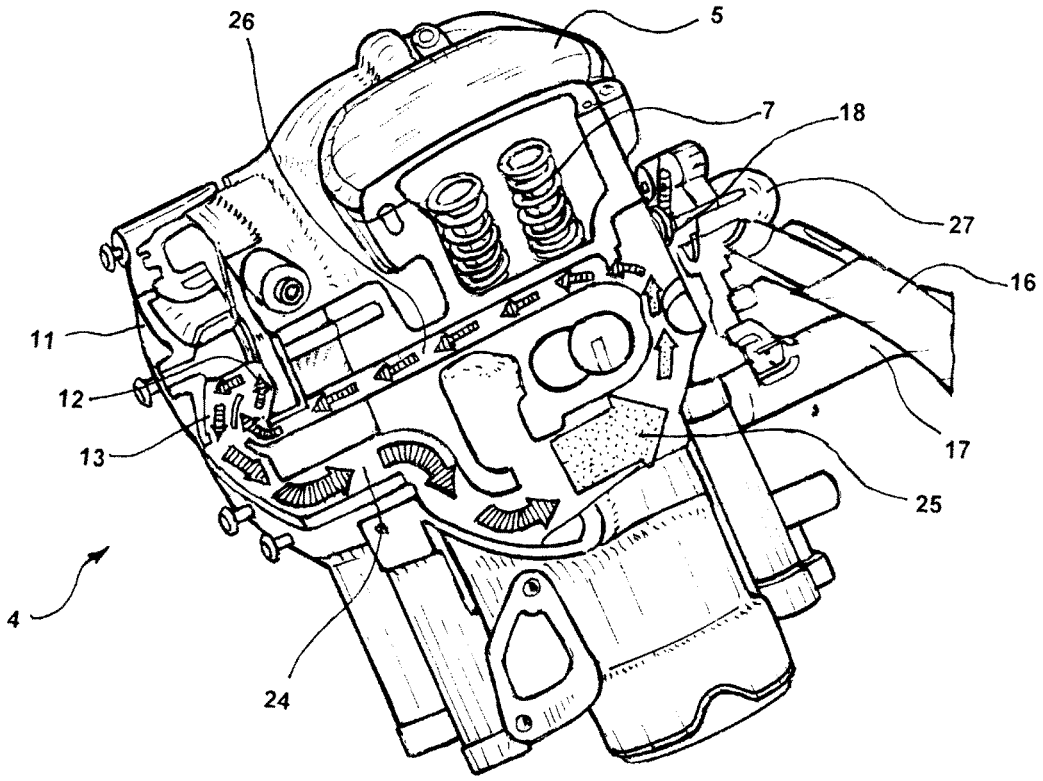
FIG. 5 shows an enlarged axonometric view in partial section of the second cooling circuit of FIG. 4 and of the relative circulation.
Figure 6:
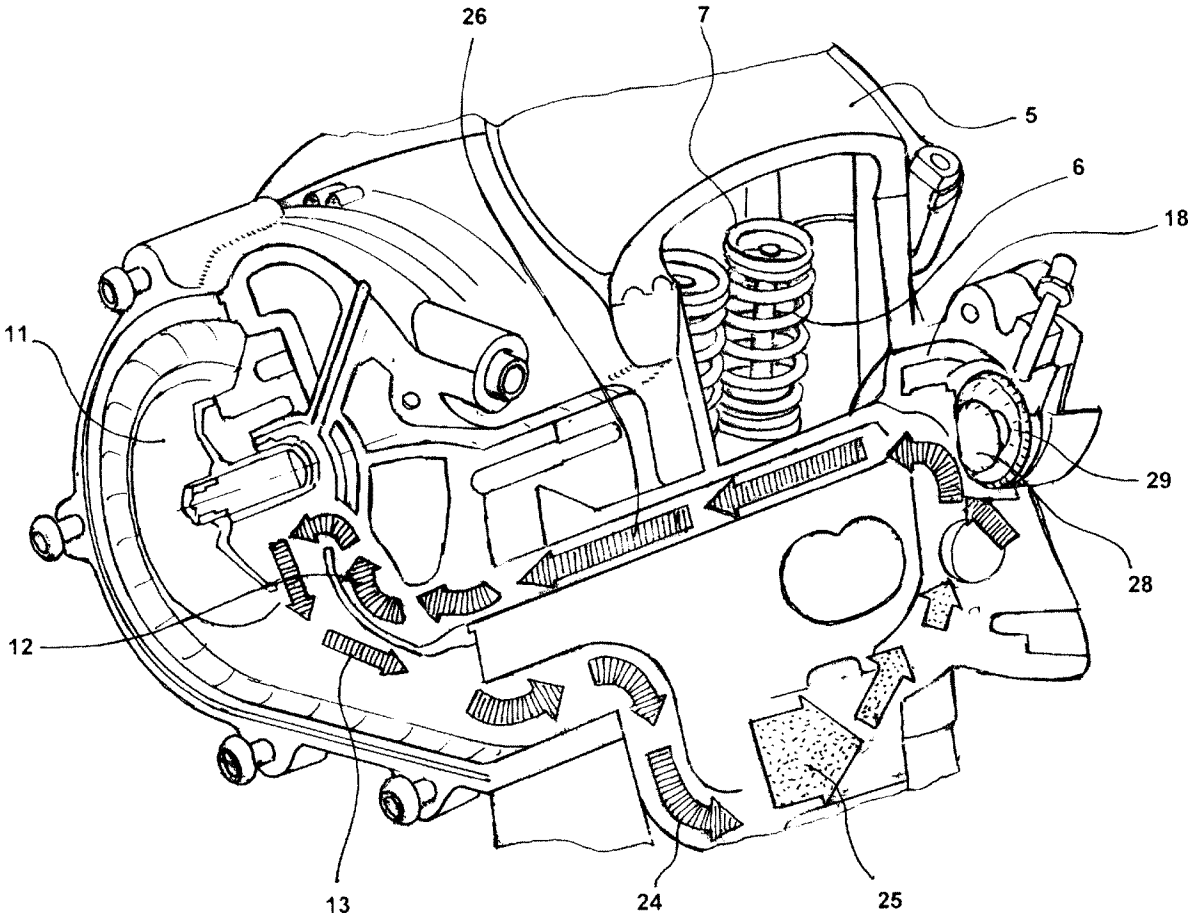
FIG. 6 shows an enlarged axonometric view in partial section of the second cooling circuit of FIG. 4 and of the relative circulation from a different perspective making the pump visible.
Figure 7:
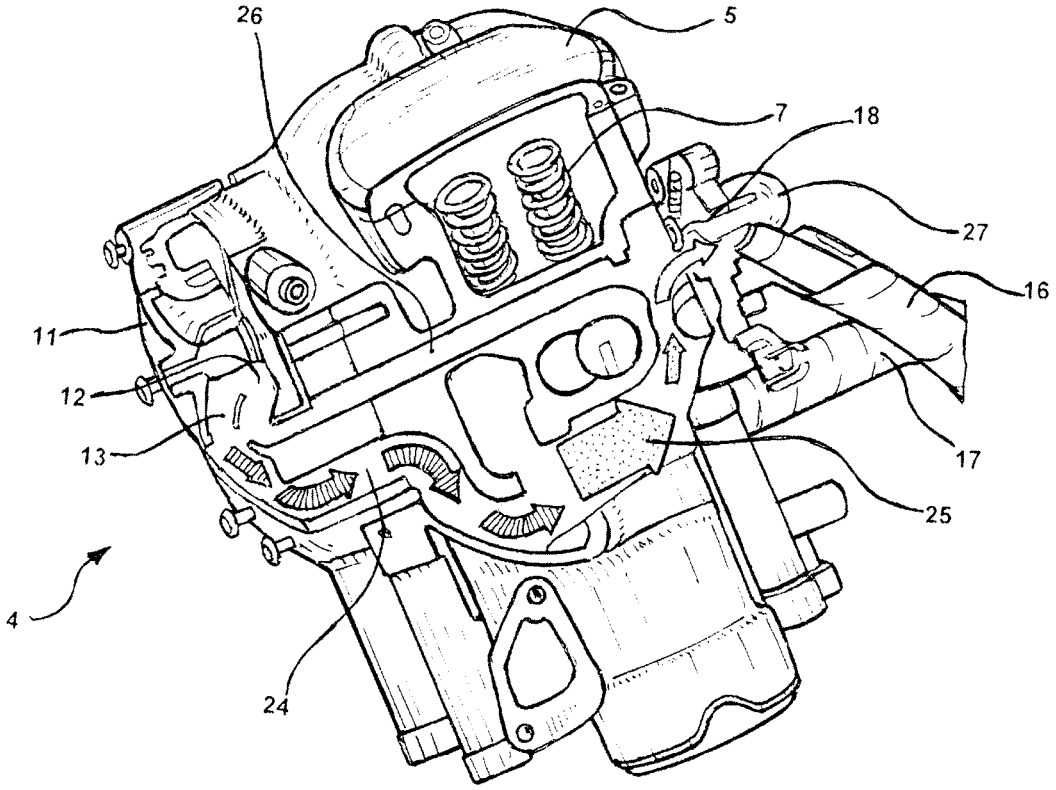
FIG. 7 shows an enlarged axonometric view in partial section of the first cooling circuit of FIG. 4 and of the relative circulation.
Figure 8:
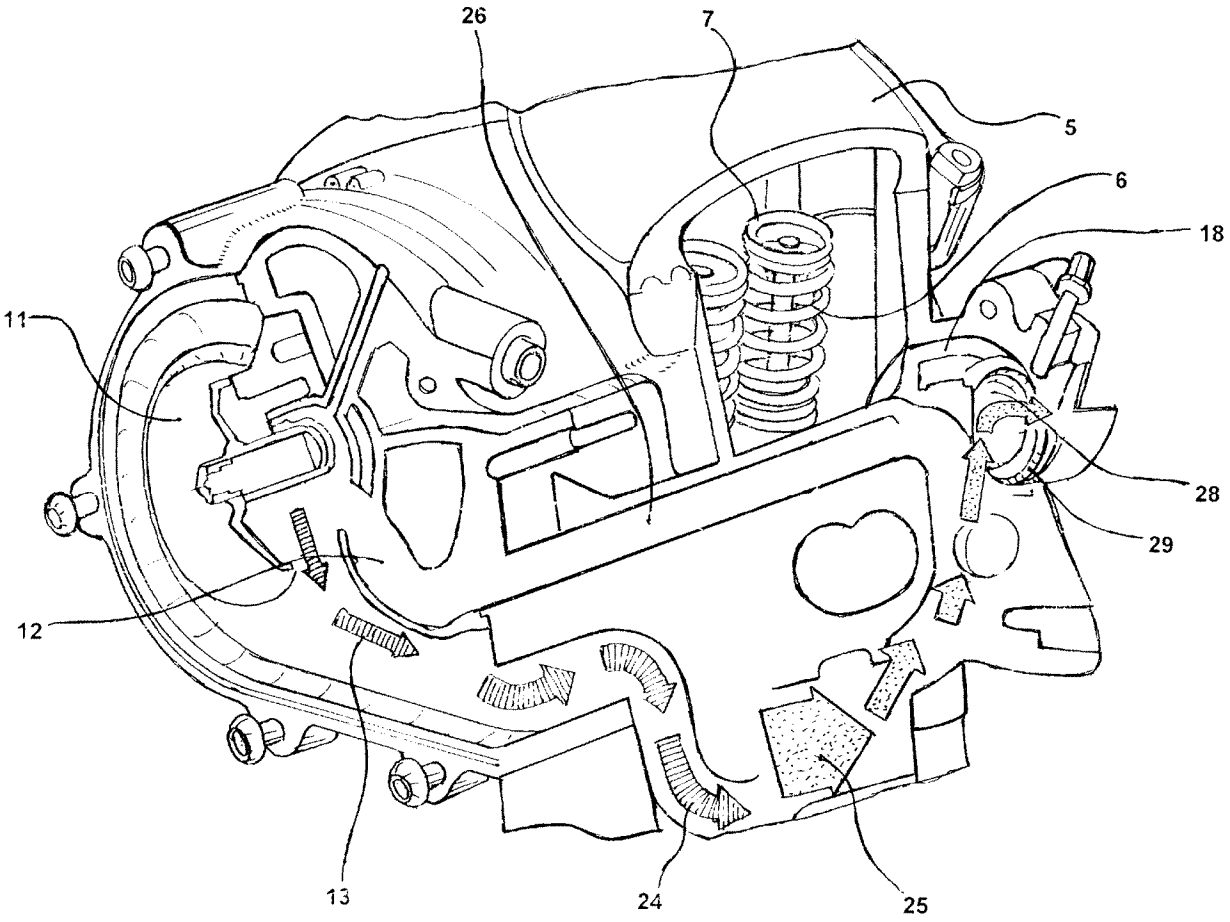
FIG. 8 shows an enlarged axonometric view in partial section of the first cooling circuit of FIG. 4 and of the relative circulation from a different perspective making the pump visible.

The engine 1 has an engine block 2, obtained from one only single-piece melting. A driving axle A is defined therein, substantially perpendicular to a longitudinal development of the internal combustion engine, transversal thereto. The driving axle A results from a crankshaft 3 (FIG. 3) receiving the motion from the piston of the engine 1.

In the engine block 2 the casing of the cylinder 4 and two casings of the valvetrain system 5, arranged ahead according to a V scheme, are distinguished: the valvetrain system comprises a pair of intake valves and a pair of discharge valves, the stems thereof 6 are controlled, in opposition to a respective spring 7, by a (not visible) camshaft arranged transversally and housed in a valvetrain box belonging to the same engine block 2.

The engine 1 comprises a cooling system which, in turn, has a radiator 8 arranged laterally to the engine block 2, a relative fan 9 interposed between engine block 2 and radiator 8.

The fan 9 of the radiator 8 is fitted directly onto the crankshaft 3 and it is dragged into rotation therefrom when the engine 1 is operating.

Between the fan 9 and the engine block 2 there is also an electric motor 10; the rotor thereof is fitted onto the crankshaft 3 too. The electric motor 10 operates as starter motor and as current generator.

The engine block 2 inside thereof has a water-circulating pump 11 comprising a intake nozzle 12 and a discharge nozzle 13. The pump 11 is set in motion by a timing chain actuating even said camshaft, connected to said crankshaft 3.

This scheme distinguishes for the compactness thereof. It is to be noted that fan 9, with the radiator 8, and pump 11 are arranged on opposite sides of the engine.

The crankshaft 3 is connected to a valvetrain system received in a respective transmission casing 14 arranged on the opposite side of the engine 1 with respect to the fan and to the radiator 8. It includes the driving pulley, the driven pulley, a transmission belt and the (not visible) speed varying and reducing organs. On the opposite end with respect to the driving axle A the transmission system comprises a pin 15 thereon the (not visible) rear wheel of the scooter will be mounted.

The radiator 8 and the fan 9 are portion of a cooling system of the engine 1, comprising a first outer cooling circuit and a second inner cooling circuit.

The first cooling circuit comprises a discharge line 16 and an extraction line 17 connecting the radiator 8 to said engine block. These lines 16, 17 are constituted by hoses outside the engine block 2.

The discharge line 16 connects a discharge opening 18, which is formed on the engine block 2, that is on the outer surface thereof, to an inlet nozzle 19 of the radiator 8, which gives access to a discharge manifold 20 accessible even through an upper opening closed by a screw stopper 21.

The extraction line 16 connects a discharge opening 22 of the radiator 8 and a intake opening 23 connecting to said intake nozzle 12 of the pump 11.

The first cooling circuit further comprises an inner circuit portion for extracting the heat from the engine which, by following the water path, goes from the discharge nozzle 13 of the pump 11 to the discharge opening 18 leading then to the radiator 8. In the middle, such portion comprises an inlet line 24, obtained inside the cylinder block 4, and a cooling path 25 which is in contact with the outer walls of the cylinder, that is with the inner casing thereof.

As previously mentioned, the cooling system even comprises a second cooling circuit wholly included in the engine block 2 for the cooling water recirculation.

It comprises a by-pass line 26 connecting said discharge opening 18 directly to the intake nozzle 12 of the pump 11, passing through the engine block 2.

The second circuit then comprises said inner circuit portion for extracting the heat from the engine, already described previously.

At last, the cooling system comprises a by-pass valve 27, which is arranged on the engine block 2 at said discharge opening 12.

Such by-pass valve comprises a shutter 28 connected to an actuating stem 29, which is dipped into the circulating water at the discharge opening 18. Such stem 29 incorporates a thermostat sensible to the water temperature, capable of actuating the by-pass valve by varying the length thereof, and then the position of the shutter 28.

The latter is mobile between:

- a first position wherein it obstructs the discharge opening 18 by preventing the water to flow into the radiator 8 through the discharge line 16; in this first position the water then will flow into the by-pass line 26 by going back directly to the pump; and
- a second position wherein the shutter 28 is moved away from the discharge opening 18, by allowing the passage of the water therethrough but at the same time by preventing it to circulate in the by-pass line 26 as it obstructs the proximal mouth thereof.

The passage from the first position to the second position (and vice versa) takes place when the temperature of water, or of any cooling liquid, exceeds a reference temperature.

Therefore the cooling system operates as follows.

When the engine is cold, in particular as it has been just started, the cooling water is below said reference temperature and the engine does not need to be cooled down, but on the contrary it needs to reach an optimum operating temperature in the shortest time possible.

Then, the shutter 28 of the by-pass valve 27 closes the discharge opening 18 on the engine block 2 thus by preventing the water to flow into the radiator 8 and the engine to cool down, since the fan however is operating.

As the heating proceeds, the water will find above the reference temperature, that is at the optimum operating temperature. In this state, the shutter 28 is controlled so as to open the discharge opening 18 and, on the contrary, to obstruct the proximal end of the by-pass line 26. In this configuration, the water can flow into the radiator 8 and the engine 1 is refrigerated.

Although it has been described by referring to a single-cylinder engine, it is meant that the same cooling scheme can be adopted even in two-cylinder or multi-cylinder engines, provided that they are cooled with water and/or liquid.

To the above-described engine a person skilled in the art, with the purpose of satisfying additional and contingent needs, could introduce several additional modifications and variants, all however within the protective scope of the present invention, as defined by the enclosed claims.

The invention claimed is:

1. A water-cooled internal combustion engine (1), for equipping scooters and motorcycles, having:

a monobloc engine block (2) with a crankshaft substantially perpendicular to a longitudinal development of the internal combustion engine;

a cooling system comprising a radiator (8), a fan (9) related thereto and a water circulating pump (11), driven by said crankshaft, comprising an intake nozzle (12) and a discharge nozzle (13), the fan (9) directly fitted onto said crankshaft (3), interposed between the radiator and the engine block the fan (9) lying on a plane substantially parallel to said longitudinal development; and an electric motor operated as a starter motor and as a current generator, arranged between the fan and the engine block and comprising a rotor fitted onto said crankshaft, said cooling system further comprises:

a first cooling circuit having:

a discharge line (16) and a extraction line (17) connecting the radiator (8) to said engine block (2), said discharge and extraction lines (16, 17) being constituted by tubes outside the engine block (2) with respective discharge openings (18), formed in said engine block (18), and intake opening (23) connected to said intake nozzle (12) of the pump (11);

an inner circuit portion (24, 25) for extracting heat from the engine;

a second cooling circuit wholly included in said engine block (2) for recirculating cooling water, comprising a by-pass line (26), connecting said discharge opening (18) to the intake nozzle (12) of the pump (11), and said inner circuit portion (24, 25) for extracting the heat from the engine (1); and a by-pass valve (27), arranged on the engine block (2) at said discharge opening (18), actuated by a thermostat (29) sensible to the water temperature, allowing the water circulation either in said first cooling circuit, above a reference temperature, or in said second cooling circuit, below said reference temperature.

2. The engine (1) according to claim 1, wherein the engine (1) is a single cylinder type engine.

3. The engine (1) according to claim 2, wherein the engine (1) is arranged so that the longitudinal development thereof is in a direction of the length of the vehicle housing it, the cylinder received in the engine block being arranged according to the same scheme, tilting ahead so that a cylinder head is directed to the front side.

4. The engine (1) according to claim 1, wherein the circulating pump (11) is set in motion by a timing chain which actuates even a camshaft of the valvetrain system.

5. The engine (1) according to claim 1, wherein the by-pass valve (27) comprises a shutter (28) connected to an actuating stem (29), which is dipped into the circulating water at the discharge opening (18), which in turn incorporates a thermostat sensible to the water temperature, capable of actuating the by-pass valve by varying the length thereof, and therefore the position of the shutter (28).

6. The engine (1) according to claim 5, wherein the shutter (28) is mobile between:

a first position wherein the shutter obstructs the discharge opening (18) by preventing the water to flow into the radiator (8) by means of the discharge line (16); in this first position the water then will flow into the by-pass line (26) by going back directly to the circulating pump (11); and a second position wherein the shutter (28) is moved away from the discharge opening (18), by allowing the passage of the water therethrough but at the same time by preventing the water to circulate in the by-pass line (26) as the shutter obstructs the proximal mouth thereof.

* * * * *